United States Patent [19]

Blunt

[11] 4,099,353

[45] Jul. 11, 1978

[54] BURIAL CRYPT AND METHOD OF INSTALLATION

[76] Inventor: Dan R. Blunt, 360 Glenview, Canfield, Ohio 44406

[21] Appl. No.: 754,018

[22] Filed: Dec. 23, 1976

[51] Int. Cl.[2] ..... E04H 13/00

[52] U.S. Cl. ..... 52/139; 52/124; 52/169.5; 52/169.6

[58] Field of Search ..... 52/128, 139, 135, 134, 52/169.5, 124, 169.6, 125, 136, 79.9

[56] References Cited

U.S. PATENT DOCUMENTS 3,604,166 9/1971 Ciccarelli ..... 52/127 X 3,772,826 11/1973 Ferrer ..... 52/124 X

*Primary Examiner*—Ernest R. Purser
*Assistant Examiner*—Carl D. Friedman
*Attorney, Agent, or Firm*—Webster B. Harpman

[57] ABSTRACT

A plurality of burial crypts of identical configuration are arranged in a pre-excavated burial area in side by side relation, leveled with respect to one another by interconnecting adjustable means and the areas therebetween and thereover back filled whereby access can be obtained to any given crypt with a minimum of effort and whereby the crypt can be sold as a part of the cemetery plot with an improved utilization of the burial area.

6 Claims, 7 Drawing Figures

BURIAL CRYPT AND METHOD OF INSTALLATION

BACKGROUND OF THE INVENTION

1. Field of the Invention

This invention relates to burial crypts and a method of installing the same in a burial area where the general area is first excavated, the crypts installed and the area back filled to re-establish a desirable surface contour.

2. Description of the Prior Art

Prior burial crypts have generally comprised concrete vault-like structures and it has been proposed that such structures be pre-positioned in a burial area and back filled for subsequent opening and use. See for example U.S. Pat. No. 3,295,271 and U.S. Pat. No. 3,772,826. Many variations in concrete vaults and crypt-like structures have been proposed and representative structures may be seen in patents Nos. 1,030,385, 1,333,423, 1,959,204 and 3,230,674.

The present invention discloses the use of a relatively lightweight burial vault or crypt formed of a synthetic resin with relatively thin walls and a method of installing the burial crypts in closely spaced relation with the side walls of the same being interconnected for mutual support and facilitating the leveling and positioning of the individual burial crypts in a pre-excavated burial area.

SUMMARY OF THE INVENTION

A burial crypt and a method of installing a plurality of the same utilizes a lightweight, relatively thin walled crypt and cover formed of a suitable synthetic resin with means interconnecting the side walls of adjacent crypts to provide a reinforcing effect and a desirable relative positioning of the crypts in side by side arrangement. A plurality of the crypts are installed in a pre-excavated burial area in which an under drainage system has been installed and leveling devices are positioned on the drainage material such as gravel to facilitate the leveling of the individual crypts in their multiple side by side arrangement in the burial area.

DESCRIPTION OF THE PREFERRED EMBODIMENT

Figure 1:
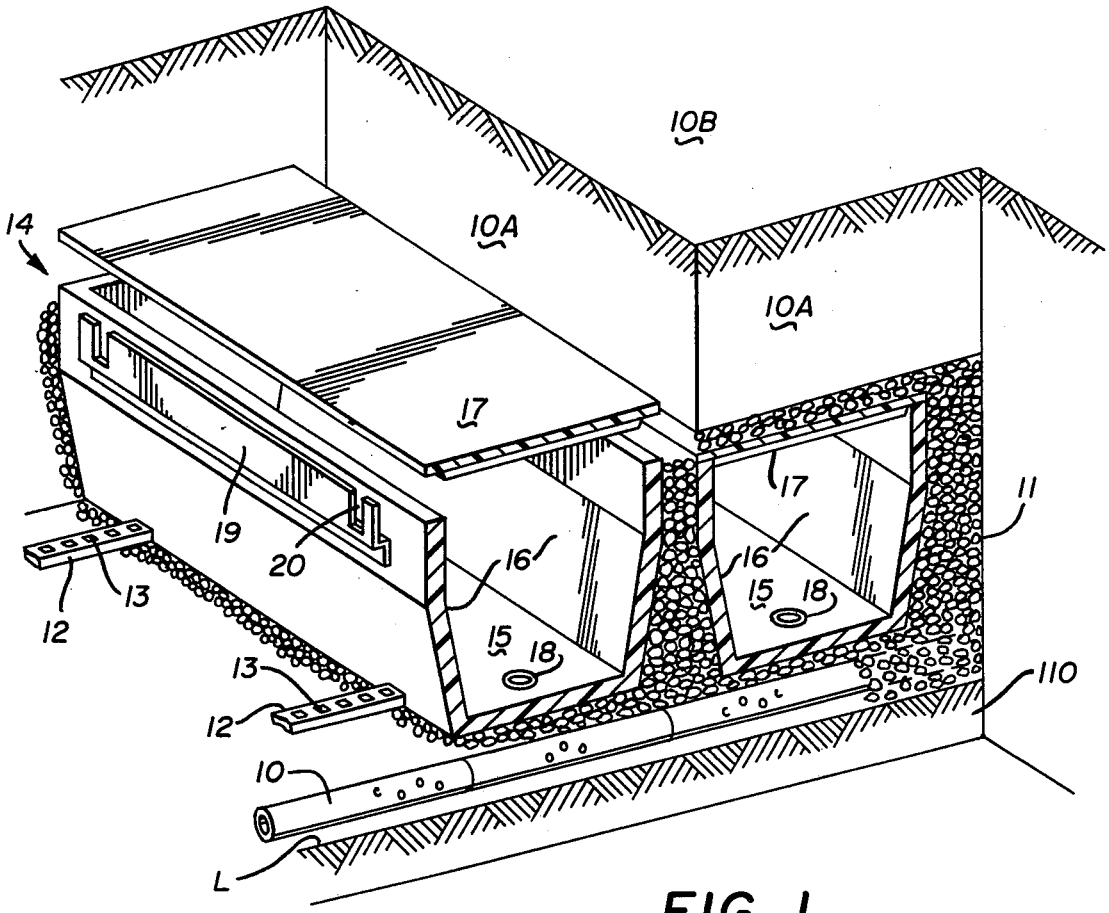
FIG. 1 is a perspective elevation with parts in cross section and parts broken away showing a pair of the burial crypts in a common excavation.

The burial crypt and the method of installing a plurality of the same in a pre-excavated burial area which is subsequently back filled to form the desirable contour of a cemetary is disclosed in FIG. 1 of the drawings and by referring thereto it will be seen that the earth 10 has been excavated to a level L, perforated drain tiles 10 installed and led to a suitable drain point and a covering filling of drainage material such as gravel 11 installed thereover. A pair of track-like guides 12, each of which have a plurality of longitudinally spaced perforations 13 are positioned in spaced parallel relation on the gravel or other drainage material 11. A plurality of individual crypts generally indicated at 14 are then installed on the track-like guides 12 in side by side rather closely spaced relation. Each of the burial crypts 14 has an integrally formed bottom 15, side walls 16 and a removable cover 17. The bottoms 15 are apertured as at 18 so that any liquid entering the crypts 14 will drain outwardly through the gravel or drainage material 11 and be disposed of through the perforted drain tile 10.

Figure 2:
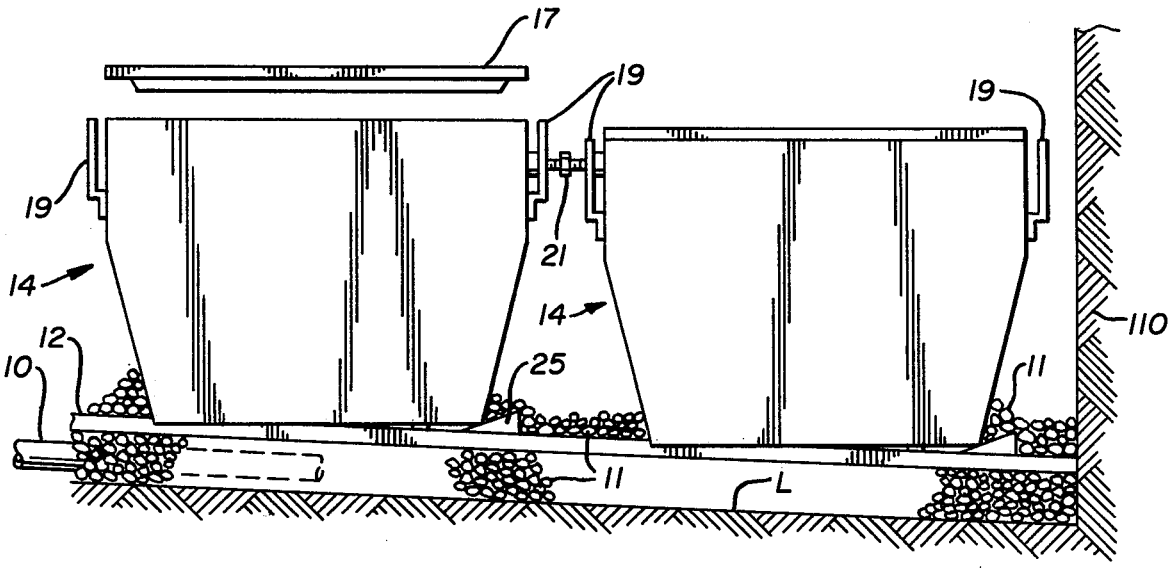
FIG. 2 is an enlarged end elevation of the burial crypts seen in FIG. 1 of the drawings.

By referring to FIGS. 1 and 2 of the drawings, it will be seen that each of the individual crypts 14 are provided with brackets 19 on their opposite upper sides, the brackets 19 preferably being slotted as at 20 so that a plurality of connectors 21 may be engaged therein to adjustably join the side walls of the burial crypts 14 to one another as best seen in FIG. 2 of the drawings. Each of the connectors 21 is formed of a pair of oppositely disposed flanged end members 22 which are internally threaded so as to engage the opposite ends of a threaded bar 23. The middle portion of the threaded bar 23 is provided with an enlarged section having multiple flat areas 24 to facilitate receiving a wrench or the like by which the threaded bar 23 may be revolved to move the flanged end members 22 in an expanding or contracting action.

In FIG. 2 of the drawings, it will be seen that the connectors 21 are thus capable of moving the adjacent burial crypts 14 into satisfactory position and alignment with one another and at the same time tension the same so as to provide mutual reinforcing support of the joined side walls of the burial crypts.

Figure 6:
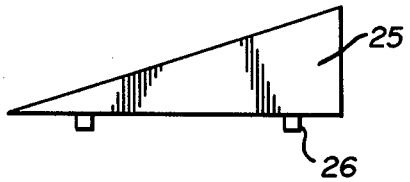
FIG. 6 is a side elevation of a wedge member as seen in FIG. 2 of the drawings.
Figure 7:
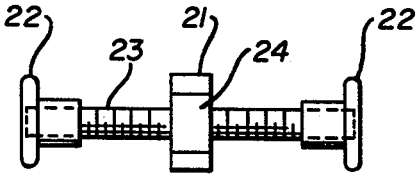
FIG. 7 is an enlarged detailed view of an interconnecting reinforcing and adjustment member as seen in FIG. 2 of the drawings.

Still referring to FIG. 2 of the drawings, it will be seen that when the level L of the excavation is angularly disposed, wedges 25 having depending bosses 26 as best seen in FIG. 6 of the drawings are positioned on the track-like guides 12 and used to level the burial crypts 14 as desired.

By referring to FIG. 1 of the drawings again it will be seen that once the individual burial crypts 14 are positioned on the track-like guides 12, and leveled where necessary through the use of the wedges 25, the covers 17 having been installed earlier or at this time if desired and gravel or other suitable drainage material is then back filled around the burial crypts 14 between them and in overlying relation with respect to the covers 17 for several inches. The earth which was previously excavated from the burial area is then refilled as indicated by the numerals 10A in FIG. 1 of the drawings and eventually grass is established thereon either by seeding or sodding and in the area indicated by the numeral 10B. Thus a burial area is formed which may be quite extensive and include a great many of the individual burial crypts 14 which are then sold along with the burial plots in the cemetary incorporating the burial area. At the time of use it is relatively simple and easy to excavate the earth 10A above the pre-positioned burial crypts 14 and the same are then readily available for receiving a casket as will be understood by those skilled in the art.

Figure 3:
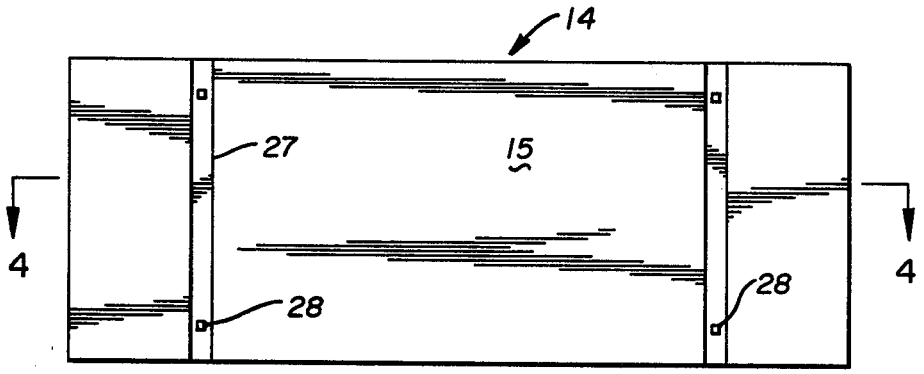
FIG. 3 is a bottom view of one of the burial crypts seen in FIGS. 1 and 2 of the drawings.
Figure 4:
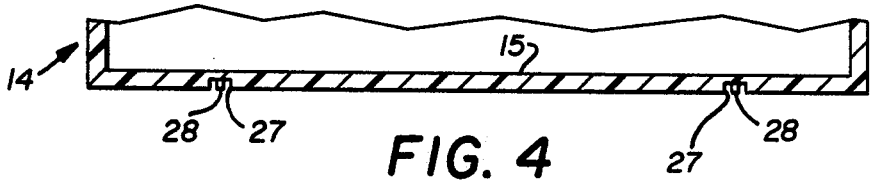
FIG. 4 is a horizontal section on line 4—4 of FIG. 3.
Figure 5:
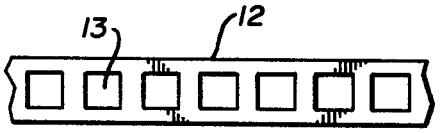
FIG. 5 is a plan view of a portion of a perforated guide member as seen in FIGS. 1 and 2 of the drawings.

By referring now to FIG. 3 of the drawings a bottom view of one of the burial crypts 14 may be seen and it will be observed that it has transversely positioned channels 27 formed in the bottom with depending pins 28 positioned therein. These channels 27 receive the track-like guides 12 as seen in FIGS. 1 and 2 of the drawings and heretofore descirbed and as illustrated in enlarged detail in FIG. 5 of the drawings and the pins 28 register with the perforations 13 in the track-like guides 12 so that the individual burial crypts 14 are positioned in fixed relation relative thereto and will retain that positioning when the gravel or drainage material 11 is installed as heretofore described.

It will thus be seen that a burial crypt of relatively thin wall, lightweight construction has been disclosed together with a method of installing the same in interlocking, inter-dependent supporting relation to adjacent similar burial crypts, each of which is provided with a cover and the cover in turn is provided with ribs, the ends of which are tapered so as to insure the desirable spacing of the side walls 16 of the crypts with respect to one another. The arrangement and the method disclosed is such that the crypts retain their desired level uniformly spaced relation during the back filling of the drainage material or gravel and the earth thereover and thus insure the accurate and desirable positioning necessary in the completed burial area of the cemetary all of which contributes to the efficient and relatively inexpensive opening of the crypt at the time of need.

Although but one embodiment of the present invention has been illustrated and described, it will be apparent to those skilled in the art that various changes and modifications may be made therein without departing from the spirit of the invention and having thus described my invention what I claim is:

1. A burial crypt and means for positioning a plurality of the same in an excavation in inter-dependent relation to one another, said burial crypt being unitary and comprising a thin walled, lightweight, rectangular box having an open top and integral side, bottom and end walls and a cover registering with said open top, brackets on the upper sides of said burial crypt said brackets each including an elongate member attached to a corresponding side wall for a substantial length of that corresponding side wall at a location spaced from the top of that side wall, said elongate members each having a top edge spaced apart from the corresponding wall top edge, said elongate member having openings defined therein adjacent the top edge thereof, connecting members for engaging said bracket elongate members on adjacent burial crypts and joining the same to one another, said connecting members each including a bar member and an end member attached to each end of said bar, said bar members being received in bracket openings of said adjacent crypts with said end members each abutting a side wall of one of said adjacent crypts so that said side walls are connected by said connecting members in a manner which forms mutual reinforcing support of said joined side walls so as to enable said burial crypts to retain their desired position during a subsequent back-filling operation and support said back fill.

2. The burial vault set forth in claim 1 and wherein said connecting members are extensible and contractible.

3. A burial crypt and means for positioning a plurality of the same in an excavation in inter-dependent relation to one another, said burial crypt being unitary and comprising a thin walled, lightweight, rectangular box having an open top and integral side, bottom, and end walls and a cover registering with said open top, brackets on said crypt sides, said brackets each including an elongate member attached to one side of said box for a substantial length of said one side and having openings defined therein, connecting members for engaging bracket elongate members on adjacent burial crypts to connect said adjacent crypts together, said connecting members each including an elongate member received in bracket openings of adjacent crypt connecting elongate members and abutting means on each end of said each connecting member, each abutting member abutting a side of one of the adjacent crypts to transfer forces from one crypt to an adjacent crypt so that said adjacent crypts mutually reinforce each other thereby permitting said adjacent burial crypts to retain a desired position during a backfilling operation and to support the back fill.

4. A burial crypt and means for positioning a plurality of the same in an excavation in inter-dependent relation to one another, said burial crypt comprising a thin walled, lightweight, rectangular box having an open top and integral side, bottom and end walls and a cover registering with said open top, brackets on the sides of said burial crypt and connecting members for engaging said brackets on adjacent burial crypts for securing the same to one another and moving the crypts relative to one another so as to enable said burial crypts to retain their desired position during a subsequent back filling operation, said bottom wall having at least one transverse channel formed upwardly therein in the lower surface thereof, and said channel having a track-like guide member located in supporting relation to said crypt.

5. A burial crypt and means for positioning a plurality of the same in an excavation in inter-dependent relation to one another, said burial crypt comprising a thin walled, lightweight, rectangular box having an open top and integral side, bottom and end walls and a cover registering with said open top, brackets on the sides of said burial crypt and connecting members for engaging said brackets on adjacent burial crypts for securing the same to one another and moving the crypts relative to one another so as to enable said burial crypts to retain their desired postiion during a subsequent back filling operation, said bottom wall having at least one transverse channel formed upwardly therein in the lower surface thereof, said channel having a track-like guide member located in supporting relation to said crypt, said channel further including a leveling wedge located between said crypt and said track-like guide.

6. The burial vault of claim 5 and wherein said track-like guide is apertured and pins are formed on said vault bottom in said channels for registry in said apertures.

* * * * *